United States Patent [19]

Lefebvre

[11] Patent Number: 4,981,118

[45] Date of Patent: Jan. 1, 1991

[54] POPPET VALVE FOR INTERNAL COMBUSTION ENGINE

[76] Inventor: Pierre Lefebvre, 71, Dazé Street, Sainte-Agathe, Canada, J8C 1Y7

[21] Appl. No.: 508,161

[22] Filed: Apr. 12, 1990

[51] Int. Cl.[5] ..... F01L 3/00

[52] U.S. Cl. ..... 123/188 AA; 123/432

[58] Field of Search ..... 123/188 AA, 188 B, 188 R, 123/188 M, 432; 251/356, 336

[56] References Cited

U.S. PATENT DOCUMENTS 2,799,266 7/1957 Kinman ..... 123/188 B 4,790,272 12/1988 Woolenweber ..... 123/188 B

*Primary Examiner*—E. Rollins Cross

[57] ABSTRACT

A poppet valve for an internal combustion engine, comprising at least two valve stems and a single non circular valve head attached at one end of the valve stems wherein the stems are spacedly parallel to each other. The valve head has an oval or semi-circular peripheral contour for maximum cylinder breathing. The valve stems positively prevent valve head rotation and define a high surface to volume ratio, for increased heat dissipation capacity.

16 Claims, 3 Drawing Sheets

POPPET VALVE FOR INTERNAL COMBUSTION ENGINE

FIELD OF THE INVENTION

This invention relates to four cycle internal combustion engines, and more particularly, to the valves controlling the cylinder intake and exhaust.

BACKGROUND OF THE INVENTION

In the pursuit of higher motor engine performance, automobile engineers have for the last few years introduced engines with multiple valves per cylinder (usually four), which in a four-cylinder car add up to a 16-valve engine, or 32 in a V-8. There are two sets of valves in an engine: intake valves that open to let the fuel-air mixture into the cylinder, and exhaust valves that open to expel the combustion fumes. The use of multiple valves increases the efficiency of the exchange of gases. That allows an engine to breathe maximum output at high revolutions per minute (rpm). Their intake and exhaust valves open for longer (valve timing) and further (valve lift) than the engines in ordinary car; on the other hand, engines in ordinary cars obtain maximum performance at lower rpm. The lobes on the revolving camshafts of an engine push down the rocker arms to open the valves in the necessary sequence and at the proper time.

The engine valves each defines a valve head plate carried by an elongated stem substantially orthogonal to the plane thereof. Usually, the valve head—and therefore the valve port opening in the engine cylinder head—is of circular shape in plan view, whereby the valve stem is not for that reason precluded from rotating within the valve stem channel in the cylinder head, since, in the valve port closing position thereof, the circular (disc-shape) head sits onto an annular cavity of the valve port (inwardly of the combustion chamber).

However, in a recent breakthrough, non circular valve heads for internal combustion engines, together with correspondingly shaped valve head seats about the valve port openings thereof, have been developed. More specifically, U.S. Pat. No. 4,790,272 issued in December 1988 to Woolenweber, discloses and claims poppet valves for internal combustion engines, having various shapes, including semi-circular, quadri-circular, oval and elliptical shapes. Woolenweber claims that such valves increase the flow-through area across the engine intake and exhaust valves, increase the air quantity available in the cylinder assembly for combustion, reduces the throttling loss experienced by the cylinder assembly, increases the extent of combustion of the air-fuel mixture introduced into the cylinder assembly, reduces engine pumping losses, increases the power output of the engine, reduces the amount of residual hydrocarbons and carbon monoxide present in the exhaust gases, and provide overall a more efficient internal combustion engine, notably if it is turbocharged. Needless to say, such a valve cannot and should not rotate about the axis of its single stem, within the cylinder head stem guide channel. Indeed, if Woolenweber's valve was allowed to rotate even for a small angular value, the combustion chamber of the cylinder would not be sealed, and thus the gas compression in the combustion chamber would be very much compromised while the valve itself would rapidly become destroyed. Also this valve requires a single or two coaxial large diameter springs which take more room widthwise in the cylinder head.

OBJECTS OF THE INVENTION

The gist of the invention is therefore to improve the general concept of a non-circular valve for an internal combustion engine, as disclosed in Woolenweber's U.S. Pat. No. 4,790,272, by providing means which positively prevents any rotation of said valve about the valve port of the cylinder head.

A further object of the invention is to provide such valve member as above-described, wherein heat dissipation about the valve stem is also substantially improved.

Another object of the invention is to provide one or two springs for each valve stem thereby decreasing the transverse space required for the valve closing springs.

SUMMARY OF THE INVENTION

In accordance with the objects of the invention, there is disclosed a poppet valve for an internal combustion engine, comprising at least two valve stems and a single valve head attached at one end of the valve stems wherein said stems are spacedly parallel to each other, said valve head having a non-circular peripheral contour; characterized in that said valve stems prevent valve head rotation and define a high surface to volume ratio, for increased heat dissipation capacity.

Preferably, said valve head defines a semi-circular peripheral or oval, elliptical contour.

Advantageously, there are up to three said valve stems, each endwisely attached to the same said valve head all spacedly parallel to each other.

The invention is also directed to an internal combustion engine having one or more cylinder assemblies containing pistons, for driving the pistons by an air-fuel mixture introduced into the one or more cylinder assemblies through one or more pairs of valve apertures for combustion and for expelling the combusted air fuel mixture from the cylinder assembly through said one or more pairs of valve apertures, each of said one or more pairs of valve apertures having a movable poppet valve defining a head and at least two stems endwisely attached to the head spacedly parallel to each other, to open or close the valve apertures, at least one of said pairs of valve apertures and at least one of said poppet valve heads having a non-circular peripheral contour; further including valve stem guide means, one for each valve stem, for guiding the displacement thereof exactly axially thereof, wherein said at least one valve is positively prevented from rotating at all time; and wherein, upon the valve head thereof closing the corresponding valve port aperture, the valve head thereof positively seals at all time this valve port aperture.

Profitably, said valve stems are cylindrical rods characterized by a high surface to volume ratio, to increase heat dissipation capacity of the valve. The engine is obviously a 4-cycle engine.

More clearly stated, the invention consists of an internal combustion engine comprising: (a) at least one cylinder, defining a cylinder head; (b) one piston for each cylinder, axially movable therethrough and defining a piston head carried by an axial shaft; and (c) a combustion chamber, within said cylinder head and bounded by said piston head; further including: (d) fuel feed means, to feed fuel to said combustion chamber through an intake port aperture made into the wall of said cylinder head; (e) air feed means, to feed air to said combustion chamber through said intake port aperture; (f) a first valve member, for releasably closing said intake port aperture; (g) ignition means, to trigger an explosion of the fuel and air mixture brought into said combustion chamber by said fuel and air feed means; (h) gas escape means, for allowing gaseous by-products from said explosion to escape from said combustion chamber through an exhaust port aperture made in said cylinder first end; a second valve member, for releasably closing said exhaust port aperture; wherein each said valve member includes a single valve head plate and at least two stems endwisely anchored to said valve head plate spacedly parallel to each other, said valve head plate defining a non-circular peripheral edge section; further including guide means, to guide said valve exactly axially of the stems thereof, to positively prevent rotation thereof and wherein said port apertures each defines an annular seat, interiorly of said combustion chamber and conforming to the shape of said valve plate edge section for mating engagement therewith in a closed position in which said port is positively seal-tight; said valve plate edge section defining a plane orthogonal to the axes of the corresponding said stems of the same valve member.

Advantageously, each said valve head plate peripheral edge section defines a bevel (preferably in the range of 30 ° to 45°), and each said port aperture annular valve head seat is conformed to the bevel to match the edgewise shape of the valve head in seal-tight fashion.

Advantageously, each valve stem is associated with a valve closing spring system.

DETAILED DESCRIPTION OF THE INVENTION

Figure 1:
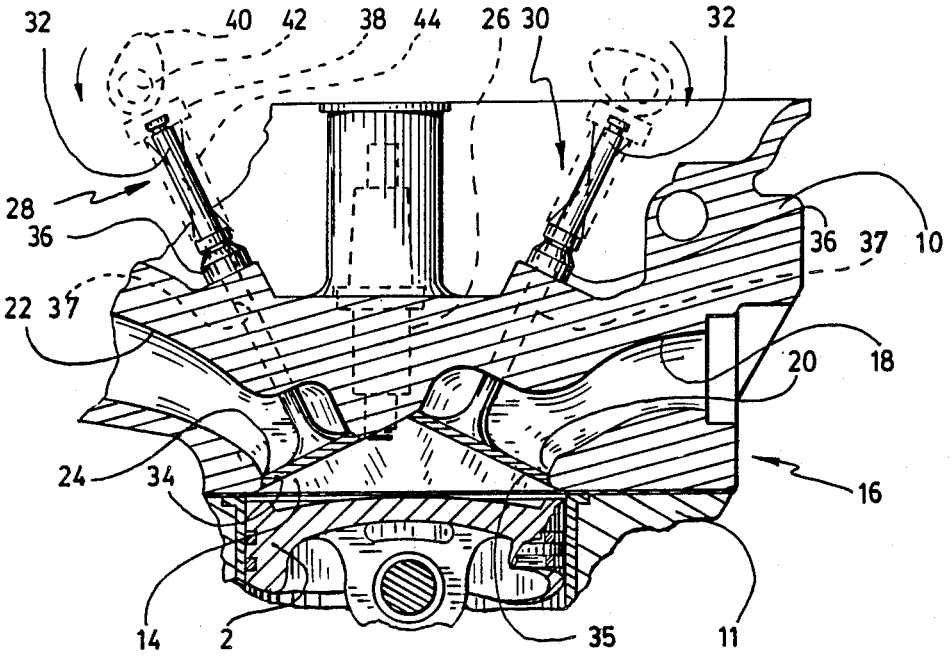
FIG. 1 is a partial cross-sectional view of a cylinder head and overhead valve assembly of an internal combustion engine, corresponding to a section taken on line 1—1 of FIG. 2.
Figure 5:
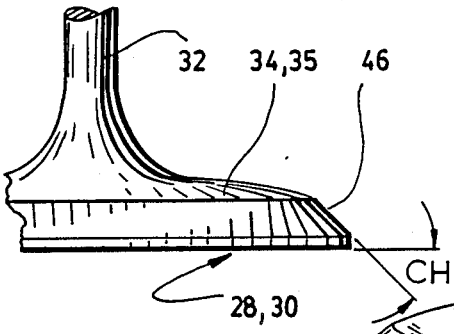
FIG. 5 shows an enlarged fragmentary elevational view of a valve member according to the invention.
Figure 3:
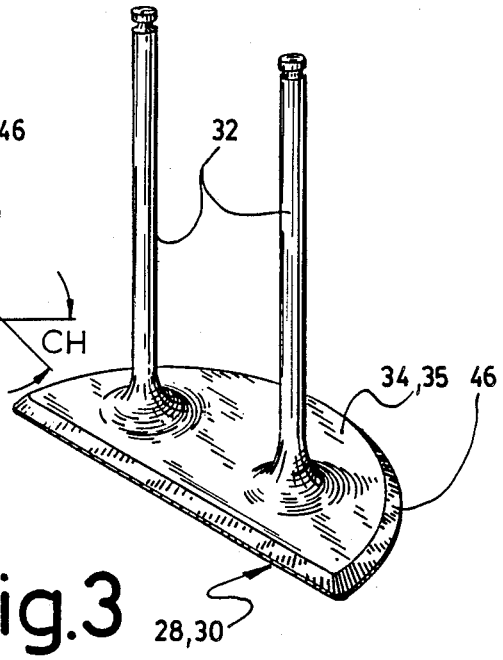
FIG. 3 is an enlarged perspective view of a double stem valve of FIG. 2.

FIG. 1 shows a cylinder head 10, an engine block 11, a piston 12 and a combustion chamber 14 of a four-cycle or four-stroke internal combustion engine 16. A fuel-air intake channel 18 leads to an intake valve port 20 made in the cylinder head, and an exhaust gas channel 22 escapes from an exhaust valve port 24 also made in the cylinder head. Valve ports 20, 24 open into combustion chamber 14. Ignition means such as two spark plugs 26 will trigger the combustion or explosion of the fuel air mixture into the combustion chamber. Valve members 28, 30 are provided, each including at least two stems 32, 32 and a valve head 34, 35 to which the stems are endwisely anchored spacedly parallel to each other. Each one of the smaller, exhaust valve head 34 and larger, intake valve head 35, is a plate with a non-circular peripheral contour, e.g. semi-circular. Each valve port 20, 24 has a valve seat which is shaped accordingly to properly seat the corresponding valve. The two stems 32 are positively guided in valve guides 36, 37. The valve heads are positively prevented from rotating relative to the valve seats. The usual rocker arm 38 pushes against both stems 32 under the action of cams 40 fixed to camshaft 42. A compression coil spring 44, or two coaxial springs, surround each stem 32 to close the valve. The peripheral edge section 46 of valve head 34 or 35 and the valve seat are bevelled by the same angle CH. Said bevel angle CH may range between 30° and 45° (FIGS. 3–5).

Each stem 32 is a cylindrical rod having a high surface to volume ratio, and all stems 32 of a valve merges with the valve head plate 34 whereby the rod axis is orthogonal to the plane of the head plate which is destined to contact the valve port seat.

Figure 4:
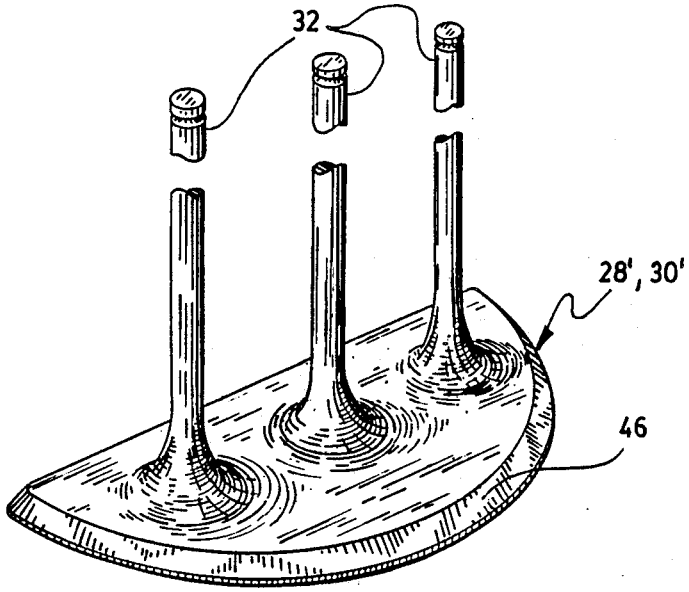
FIG. 4 is a partly broken, perspective view similar to that of FIG. 3, but showing another embodiment of valve member having three stems.

There may be three stems 32 per valve head as shown by valve 28' or 30' in FIG. 4. Four and more stems per valve head is not excluded, although two stems per valve is preferred.

Figure 2:
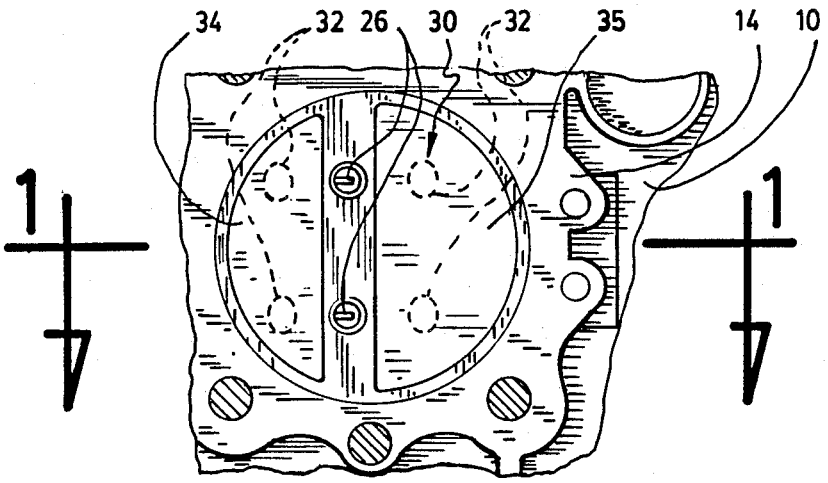
FIGS. 2, 2*a* and 2*b* are schematic views of a portion of overhead valve assembly using a two-valve (four stem) configuration, respectively showing two embodiments of semi-circular valve heads (FIGS. 2 and 2*a*) and oval valve heads (FIG. 2*b*)
Figure 2A:
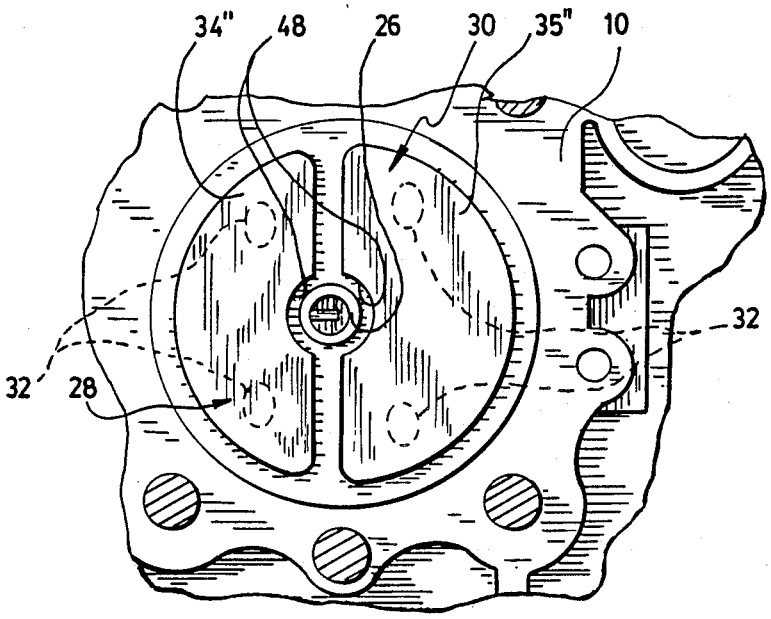

FIG. 2*a* shows an embodiment wherein the ratio of the sum of the cross-sectional areas of the two valve ports over the cylinder cross-sectional is still increased relative to the embodiment of FIG. 2.

Each valve head 34'', 35'' is provided with a notch 48 along its straight edge in register with the single central spark plug 26 as shown, or with two notches each in register with one of the two sparkplugs of FIG. 2. The valve seat is correspondingly shaped. These notches 48 permit a greater size for each valve port since the two straight edges thereof are closer to each other.

Figure 2B:
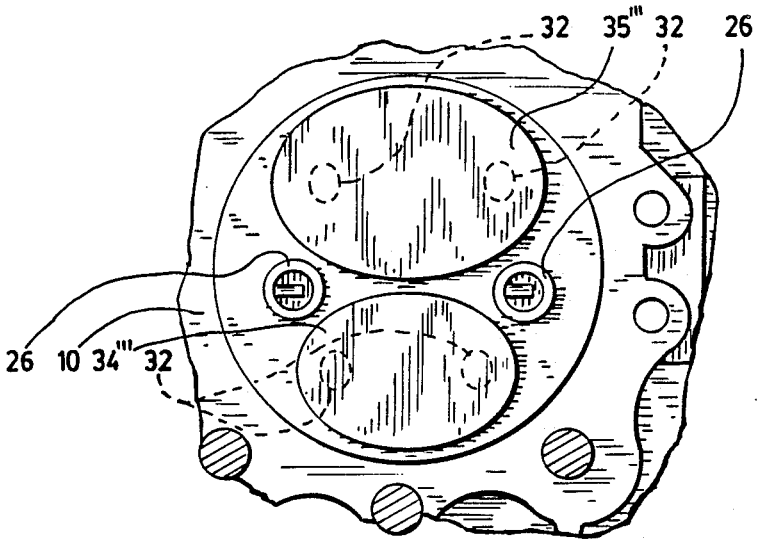

FIG. 2*b* shows valve heads 34''' and 35''' of oval shape with two spark plugs 26.

It is understood that, since there are at least two valve stems for each valve head, and in view of the conventional return spring engaging the conventional single valve stem, now, in the present invention, one or two coaxial coil springs will surround each of the two or more stems 32 per valve, wherein these springs will be downsized and the valve closing force will be better distributed over the area of the valve head.

It is noted that the valve stems can be made of a different metal than that of the valve head and welded to the latter. This permits using a material for the valve heads which has a minimum coefficient of thermal expansion to reduce valve head deformation under heat.

I claim:

1. A poppet valve for an internal combustion engine, comprising at least two valve stems and a single valve head attached at one end of the valve stems wherein said stems are spacedly parallel to each other, said valve head having a non-circular peripheral contour.

2. A valve as defined in claim 1,
wherein said valve head defines a semi-circular peripheral contour.

3. A valve as defined in claim 1,
wherein said valve head has a straight edge portion provided with at least one notch.

4. A valve as defined in claim 1,
wherein said valve head defines an elliptical or oval peripheral contour.

5. A valve as defined in claim 1,
wherein there are up to three said valve stems, each endwisely attached to the same said valve head all spacedly parallel to each other.

6. A valve as defined in claim 5,
wherein said valve head defines a semi-circular peripheral contour.

7. A valve as defined in claim 5, wherein said valve head defines an elliptical or oval peripheral contour.

8. A four stroke internal combustion engine having one or more cylinders, each having a cylinder head having one or more pairs of valve ports for air fuel mixture admission and for burnt gases exhaust respectively, each of said one or more pairs of valve ports having a movable poppet valve defining a head and at least two stems endwisely attached to the head spacedly parallel to each other, to open or close the valve ports, said valve ports and said poppet valve heads having a non-circular peripheral contour; further including valve stem guide means in said cylinder head, one for each valve stem, for guiding the displacement thereof exactly axially thereof, whereby said valves are positively prevented from rotating; and wherein each valve port forms a seat for a corresponding a valve head, whereby said said valve head positively seals said valve port when closed.

9. An internal combustion engine as defined in claim 8, wherein said valve stems are cylindrical rods characterized by a high surface to volume ratio, to increase heat dissipation capacity of the valve.

10. An engine as defined in claim 8, wherein each valve head of a pair of valves associated with a pair of valve ports defines a semi-circular peripheral contour with their straight edge portion located adjacent and parallel to each other.

11. An engine as defined in claim 10, wherein said cylinder head carries a spark plug exposed within said cylinder, each valve head having a notch in its straight edge portion partially surrounding said exposed spark plug.

12. An engine as defined in claim 8, wherein said valve head defines an oval or elliptical peripheral contour.

13. An engine as in claim 8, wherein each said valve head has a bevelled peripheral edge and each valve port seat is conformed to the bevel of said valve head peripheral edge.

14. An engine as in claim 13, wherein said bevel has a value in the range of 30° to 45°.

15. An engine as in claim 14, wherein said valve stems are cylindrical rods characterized by a high surface to volume ratio, to increase heat dissipation capacity of the valve.

16. An engine as in claim 15, with said non-circular valve head being of a shape chosen from the group comprising: oval, elliptical, and semi-circular.

* * * * *